US012655991B2

(12) United States Patent
Kwak et al.

(10) Patent No.: US 12,655,991 B2
(45) Date of Patent: Jun. 16, 2026

(54) OVEN

(71) Applicant: SAMSUNG ELECTRONICS CO., LTD., Suwon-si (KR)

(72) Inventors: Hyoseon Kwak, Suwon-si (KR); Hyunsang Kim, Suwon-si (KR); Jeonghyun Park, Suwon-si (KR); Seokang Kim, Suwon-si (KR); Byounghoon Moon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 348 days.

(21) Appl. No.: 18/203,779

(22) Filed: May 31, 2023

(65) Prior Publication Data

US 2023/0324051 A1 Oct. 12, 2023

Related U.S. Application Data

(63) Continuation of application No. PCT/KR2021/017833, filed on Nov. 30, 2021.

(30) Foreign Application Priority Data

Dec. 29, 2020 (KR) ..... 10-2020-0186113

(51) Int. Cl.
*F24C 15/18* (2006.01)
*F24C 3/08* (2006.01)
*F24C 15/32* (2006.01)

(52) U.S. Cl.
CPC ..... *F24C 15/18* (2013.01); *F24C 3/087* (2013.01); *F24C 15/32* (2013.01)

(58) Field of Classification Search
CPC ..... F24C 15/18; F24C 15/32; F24C 3/087; F24C 3/008; F24C 15/006; F24C 15/34
(Continued)

(56) References Cited

U.S. PATENT DOCUMENTS 3,512,514 A 5/1970 Vonasch
4,598,691 A 7/1986 Herrelko et al.
(Continued)

FOREIGN PATENT DOCUMENTS

CN 1899048 A 1/2007
CN 105747894 A 7/2016
(Continued)

OTHER PUBLICATIONS

Machine Translation of KR 20180027903 Description (Year: 2018).*
(Continued)

*Primary Examiner* — Allen R. B. Schult
*Assistant Examiner* — Amy E Carter
(74) *Attorney, Agent, or Firm* — STAAS & HALSEY LLP

(57) ABSTRACT

An oven according to the present invention includes: a body having a cooking chamber provided in the body; a heat source in the cooking chamber to heat the cooking chamber; and a drawer device under the body, and including: a drawer case having one or more holes in the upper surface of the drawer case; and a plate covering the one or more holes and forming a gap between the plate and the upper surface, wherein the gap is configured to allow a flow path through the gap for air in the drawer case to be supplied to the heat source through the one or more holes.

12 Claims, 13 Drawing Sheets

(58) Field of Classification Search
USPC ..... 126/21 A; 219/391, 394
See application file for complete search history.

(56) References Cited

U.S. PATENT DOCUMENTS

| | | | | |
|---|---|---|---|---|
| 4,718,400 | A * | 1/1988 | Lotz | F24C 3/008 126/41 R |
| 5,038,748 | A * | 8/1991 | Lockwood | F24C 3/008 126/41 R |
| 5,945,024 | A | 8/1999 | Fukunaga et al. | |
| 6,758,206 | B1 | 7/2004 | Barnes et al. | |
| 9,004,057 | B2 * | 4/2015 | Armstrong | A47J 37/0754 126/99 D |
| 9,012,815 | B2 | 4/2015 | Cha et al. | |
| 9,125,420 | B2 | 9/2015 | Kwon et al. | |
| 10,101,038 | B2 | 10/2018 | Kim et al. | |
| 10,364,990 | B2 | 7/2019 | Lee | |
| 11,402,105 | B2 | 8/2022 | Penuel et al. | |
| 2006/0278629 | A1 | 12/2006 | Gagas et al. | |
| 2013/0319996 | A1 | 12/2013 | Harward et al. | |
| 2015/0096550 | A1 | 4/2015 | Paller et al. | |

FOREIGN PATENT DOCUMENTS

| | | | |
|---|---|---|---|
| JP | 10-339445 | 12/1998 | |
| JP | 2001-254960 | 9/2001 | |
| KR | 10-2005-0081530 | 8/2005 | |
| KR | 10-0646881 | 11/2006 | |
| KR | 10-0778705 | 11/2007 | |
| KR | 10-2013-0011487 | 1/2013 | |
| KR | 10-1276498 | 6/2013 | |
| KR | 10-1445873 | 9/2014 | |
| KR | 10-1537407 | 7/2015 | |
| KR | 10-1634809 | 6/2016 | |
| KR | 10-1673595 | 11/2016 | |
| KR | 10-1749116 | 6/2017 | |
| KR | 10-1809178 | 1/2018 | |
| KR | 20180027903 A * | 3/2018 | H05K 7/20145 |

OTHER PUBLICATIONS

International Search Report, PCT/ISA/210, dated Mar. 17, 2022, in International Application PCT/KR2021/017833.
Written Opinion, PCT/ISA/237, dated Mar. 17, 2022, in International Application PCT/KR2021/017833.
Office Action dated Apr. 24, 2025 issued in Korean Application No. 10-2020-0186113.
Office Action dated Apr. 24, 2024, in European Application No. EP 21 91 5543.
Office Action dated Dec. 11, 2025, issued in Korean Application No. 202180085849.1.
Office Action dated Feb. 12, 2026, issued European Application No. 21 915 543.9.
Office Action dated Apr. 15, 2026, issued in Chinese Application No. 202180085849.1.

* cited by examiner

OVEN

CROSS-REFERENCE TO RELATED APPLICATIONS

This application is a continuation of International Application No. PCT/KR2021/017833, filed Nov. 30, 2021, which claims priority to Korean Patent Application No. 10-2020-0186113, filed Dec. 29, 2020, the disclosures each of which are incorporated herein by reference.

BACKGROUND

1. Field

The present disclosure relates to an oven, and more particularly, to an oven including a drawer device.

2. Description of Related Art

Ovens are food cooking appliances that include a cooking chamber, a heating device configured to apply heat to the cooking chamber, and a circulating device configured to circulate the heat generated by the heating device inside the cooking chamber.

Ovens are apparatuses that seal and heat an object to be cooked to cook the object to be cooked and may be classified into electric types, gas types, and electronic types according to the heat source thereof.

An electric oven uses an electric heater as a heat source, a gas oven uses heat caused by gas as a heat source, and an electronic oven uses friction of water molecules caused by high frequency waves as a heat source.

Generally, a drawer device for storing cookware or an object to be cooked is disposed in an oven. The drawer device is positioned under a cooking chamber of the oven. Here, there is a problem that, due to high-temperature heat generated inside the cooking chamber of the oven, an upper end surface of the drawer device is exposed to high temperatures, and a surface temperature thereof increases.

Also, there is a problem that the recent gradual increase in the capacity of the cooking chamber and a resulting decrease in the space between the drawer device and a lower end of the cooking chamber have caused an increase in the surface temperature of the drawer device.

SUMMARY

One aspect of the present disclosure provides an oven including: a body having a cooking chamber provided in the body: a heat source in the cooking chamber to heat the cooking chamber; and a drawer device under the body, and including a drawer case having one or more holes in an upper surface of the drawer case and a plate covering the one or more holes and forming a gap between the plate and the upper surface, wherein the gap is configured to allow a flow path through the gap for air in the drawer case to be supplied to the heat source through the one or more holes.

Also, the upper surface may has a first area and a second area excluding the first area, and the one or more holes may be a plurality of holes spaced apart from each other in the first area.

Also, the plate may include a flat plate portion that corresponds to the first area and a flat plate edge portion formed at an edge of the flat plate portion.

Also, the gap may be formed between the first area and the plate.

Also, the drawer case may further include one or more support protrusions that support the plate spaced apart from the upper surface.

Also, the first area may include a first area surface portion recessed from the upper surface, a first area edge portion at an edge of the first area surface portion and connected to the upper surface, and an inclined portion that connects the first area surface portion and the first area edge portion.

Also, the one or more support protrusions may be a plurality of support protrusions spaced apart from each other on the first area edge portion.

Also, the plate may further include one or more support holes that corresponds to the one or more support protrusions.

Also, the one or more support holes may be positioned in the flat plate portion.

Also, the drawer case may include a stopper that protrudes from the first area surface portion and elastically support at least a portion of the plate.

Also, the plurality of holes form an inlet portion so that air in the drawer case to enters the flow path and the first area edge portion and the flat plate edge portion form an outlet portion therebetween that the air that enters through the inlet portion is supplied toward the heat source.

Also, the body may further include a bracket to cover the heat source, and the plate may include a distance maintainer that protrudes from at least one of the flat plate portion and the first edge portion to maintain a distance between the plate and the bracket.

Also, the distance maintainer may have an embossed shape.

Also, the heat source may include at least one of a burner and a heater.

Another aspect of the present disclosure provides an oven including a body having a cooking chamber provided therein and a drawer device provided under the body, wherein the drawer device includes a drawer case provided to allow a drawer to be inserted and withdrawn and having a first insulating flow path formed therein due to air entering from an outside and a plate disposed to be spaced apart from an upper surface of the drawer case and provided to allow a second insulating flow path to be formed between the plate and the drawer case.

Also, the upper surface may include a first area and a second area excluding the first area, and at least one or more holes may be formed in the first area.

Also, the at least one or more holes may be connected to the second insulating flow path and provided to allow the air inside the drawer case to be supplied to the second insulating flow path.

Also, the body may further include a burner provided to heat the cooking chamber, and the air of the first and second insulating flow paths may move toward the burner.

Also, the drawer case may further include a support protrusion formed to protrude from the upper surface, and the plate may further include a support hole configured to correspond to the support protrusion.

In addition, the drawer case may include a stopper formed by protrusion of at least a portion of the first area and provided to elastically support the plate.

DETAILED DESCRIPTION

Figure 1:
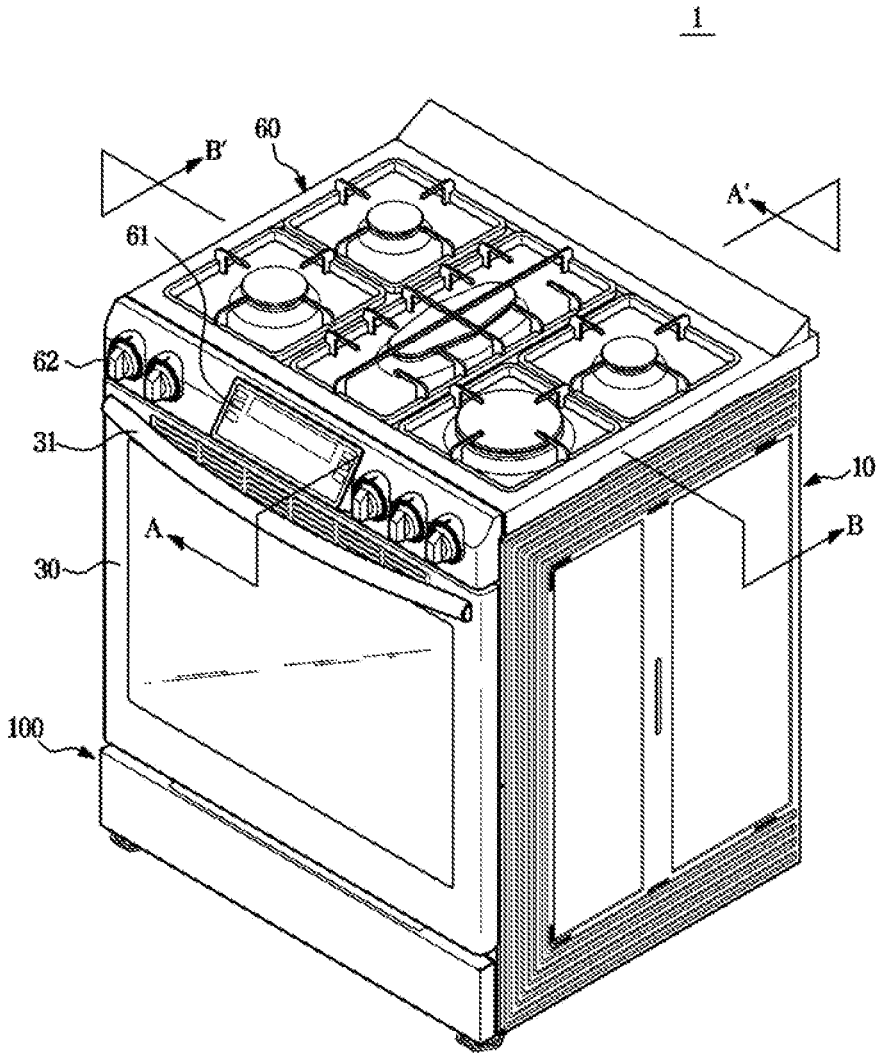
FIG. 1 is a perspective view of an oven according to one embodiment of the present disclosure.

Embodiments described herein and configurations illustrated in the drawings are merely exemplary embodiments of the present disclosure, and various modifications which may replace the embodiments and the drawings herein may be present at the time of filing this application.

Also, like reference numerals or symbols presented in the drawings of the application indicate parts or elements that perform substantially the same functions.

Also, terms used herein are for describing the embodiments and are not intended to limit and/or restrict the disclosure. A singular expression includes a plural expression unless context clearly indicates otherwise.

Terminology such as "at least one of A and B", as used herein, includes any of the following: A, B, A and B. Terminology such as "at least one of A, B, and C", as used herein, includes any of the following: A, B, C, A and B, A and C, B and C, A and B and C.

In the application, terms such as "include" or "have" are for designating that features, numbers, steps, operations, elements, parts, or combinations thereof are present, and do not preclude the possibility of presence or addition of one or more other features, numbers, steps, operations, elements, parts, or combinations thereof in advance.

Also, terms including ordinals such as "first" and "second" used herein may be used to describe various elements, but the elements are not limited by the terms, and the terms are only used for the purpose of distinguishing one element from another element.

For example, a first element may be referred to as a second element while not departing from the scope of rights of the present disclosure, and likewise, a second element may also be referred to as a first element. The term "and/or" includes a combination of a plurality of associated listed items or any one item among the plurality of associated listed items.

Meanwhile, terms such as "front," "rear," "on," and "under" used in the following description are defined based on the drawings, and the shape and position of each element are not limited by the terms.

Hereinafter, "X" may refer to a front-rear direction of a cooking chamber, "Y" may refer to a left-right direction of the cooking chamber, and "Z" may refer to an up-down direction of the cooking chamber.

Hereinafter, embodiments according to the present disclosure will be described in detail with reference to the accompanying drawings.

One aspect of the present disclosure provides an oven including a drawer device having an improved structure.

Another aspect of the present disclosure provides a drawer device and an oven including the same that can, while minimizing distances between components to implement the maximum capacity of a drawer and a cooking chamber, reduce radiant heat between the drawer and the cooking chamber, thus improving a surface temperature of the drawer.

Still another aspect of the present disclosure provides a drawer device and an oven including the same that can additionally supply air to a heater of a cooking chamber.

Yet another aspect of the present disclosure provides a drawer device and an oven including the same that can block introduction of moisture and oil, which are released from an object to be cooked placed in a cooking chamber, into a drawer.

According to the present disclosure, in order to, while increasing the volume of a cooking chamber of an oven, maintain the size of a drawer under the cooking chamber, a distance between the drawer and the cooking chamber can be minimized to optimize the capacity of the cooking chamber and the drawer.

Also, by improving structures of a heat shield plate and an upper end of the drawer, an increase in a surface temperature of a drawer case due to heat from a heater under the cooking chamber can be prevented.

Also, by improving a structure to allow air to be additionally supplied to a heater of the cooking chamber, due to an increase in the amount of introduced air, complete combustion may occur, and spread of flames can be reduced.

In addition, foreign matter such as moisture and oil falling from an object to be cooked placed in the cooking chamber can be prevented from entering the drawer, and the foreign matter can be, after being collected, naturally eliminated through heat of the heater under the cooking chamber.

The terms "front surface" and "front" used below refer to a front surface of an oven illustrated in FIG. 1 that is seen from the front of the oven and a direction toward the front of the oven, and the term "rear" refers to a direction toward the rear of the oven. Although described as being mounted on the oven, a drawer device according to an embodiment of the present disclosure may be applied to a home appliance including a drawer installed to be insertable into and withdrawable from a drawer casing. Although described as being mounted on the oven, the drawer device according to an embodiment of the present disclosure may be applied to a home appliance including a heater.

Figure 2:
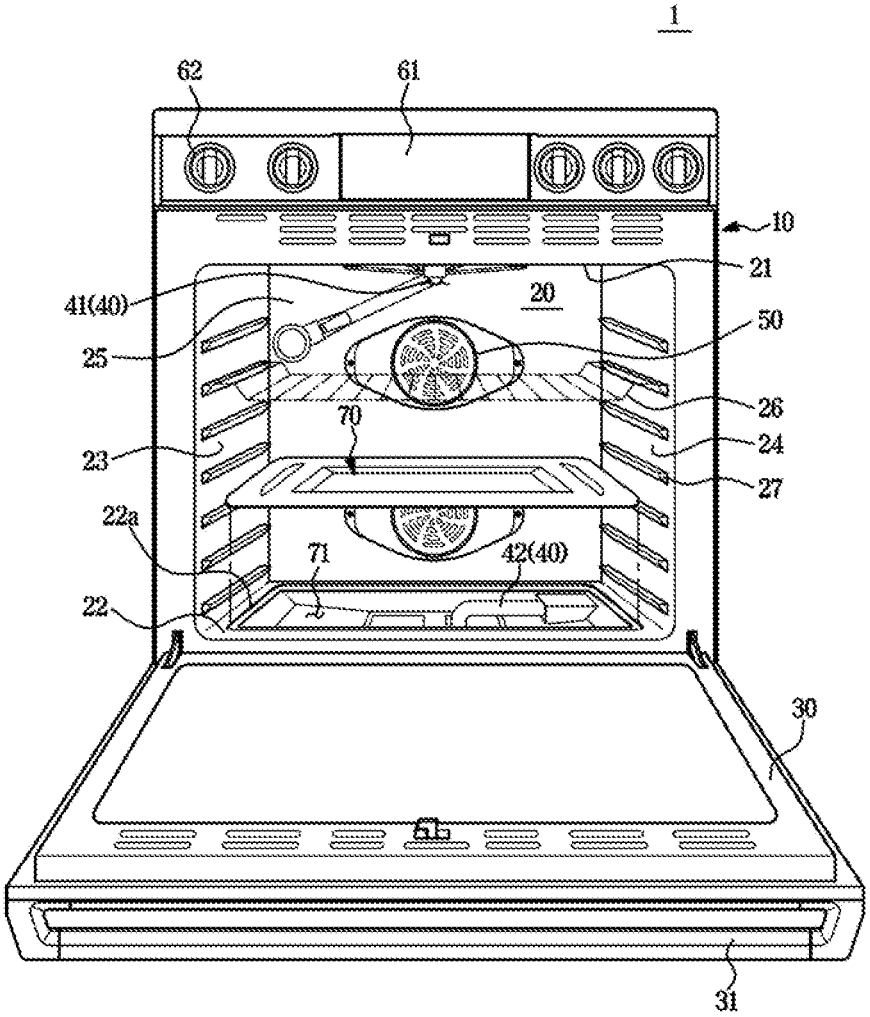
FIG. 2 is a view illustrating a state in which a door of the oven according to one embodiment of the present disclosure is open.

FIG. 1 is a perspective view of an oven according to one embodiment of the present disclosure, and FIG. 2 is a view illustrating a state in which a door of the oven according to one embodiment of the present disclosure is open.

As illustrated in FIGS. 1 and 2, an oven 1 may include a body 10 forming an exterior and having a cooking chamber 20 positioned therein, a door 30 provided to open and close the cooking chamber 20, a plurality of burners 40 provided to heat the cooking chamber 20, and a plurality of convection fans 50 provided to cause convection of air in the cooking chamber 20.

The cooking chamber 20 of the oven 1 may have a substantially box-like shape having an open front. Specifically, the cooking chamber 20 may include an upper wall 21, a lower wall 22, sidewalls 23 and 24, and a rear wall 25. The sidewalls 23 and 24 may include a left sidewall 24 and a right sidewall 23.

The oven 1 may include the door 30 provided at a front surface of the body 10 to open and close the cooking chamber 20. The door 30 may be provided with a transparent material such as glass to allow the cooking chamber 20 and a cooking process of an object to be cooked placed therein to be checked from the outside. A handle 31 may be provided at the door 30 for user convenience.

A cooktop 60 provided so that a container holding an object to be cooked is placed thereon and heated, an operation panel 62 configured to receive an operation command from a user, and a display 61 configured to display operational information of the oven 1 may be provided at an upper portion of the body 10 of the oven 1.

A plurality of supports 27 may be provided inside the cooking chamber 20. Specifically, the plurality of supports 27 may be provided at the sidewalls 23 and 24 of the cooking chamber 20. A rack 26 on which an object to be cooked may be placed may be mounted on the plurality of supports 27.

A drawer device 100 may be provided under the body 10 of the oven 1. The drawer device 100 may be provided to heat an object to be cooked or a food container for holding an object to be cooked.

The operation panel 62 is provided to allow a user to input an operation signal for operating the cooktop 60, the oven 1, and the drawer device 100. A plurality of switches is provided on the operation panel 62 to allow the user to directly input a signal. The operation panel 62 may include a configuration in a form other than the form of a switch, such as a touchscreen or a button.

The display 61 may be provided to provide operational information of the cooktop 60, the oven 1, and the drawer device 100, food cooking-related information, and the like.

The display 61 provided to display various pieces of operational information of the oven 1 and allow the user to input an operation command may be provided at an upper portion of the front surface of the body 10. The display 61 may include a liquid crystal display (LCD), and the LCD may display electrical information as visual information using a change in transmittance of liquid crystal according to an applied voltage.

The plurality of burners 40 provided to heat food may be provided in the cooking chamber 20 of the oven 1. The plurality of burners 40 may burn gas to generate heat. That is, the plurality of burners 40 may be gas burners. The plurality of burners 40 may include a first burner 41 installed at an upper portion of the cooking chamber 20 and a second burner 42 installed at a lower portion of the cooking chamber 20. The first burner 41 may be installed on the upper wall 21 of the cooking chamber 20. The second burner 42 may be installed at the lower portion of the cooking chamber 20. Specifically, the second burner 42 may be installed in a burner accommodating chamber 71 (see FIG. 3) positioned at the lower portion of the cooking chamber 20 to communicate with the cooking chamber 20. The second burner 42 may be referred to as a bake burner and may serve to indirectly heat an object to be cooked that is placed inside the cooking chamber 20.

The case in which the oven 1 includes the plurality of burners 40 as a heat source for heating the cooking chamber 20 has been described above as an example in the embodiment of the present disclosure, but the idea of the present disclosure is not limited thereto. The heat source for heating the cooking chamber may be an electric heater including an electric resistor. Therefore, the oven may include an electric oven and a gas oven.

Also, the body 10 may have a substantially box-like shape having an open front. Also, the present disclosure is not limited thereto, and the oven 1 may be installed in a built-in manner in a system kitchen.

Figure 3:
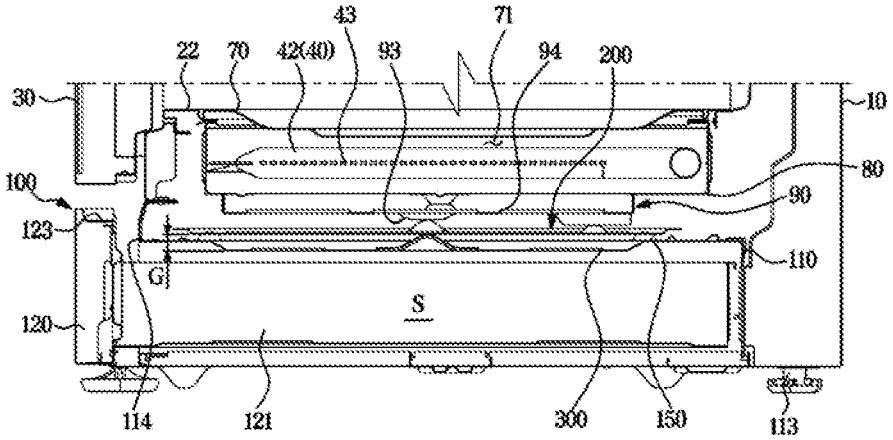
FIG. 3 is a cross-sectional view taken along line A-A' of FIG. 1 and shows a cross-section of a lower portion and a drawer device of the oven according to one embodiment of the present disclosure.
Figure 4:
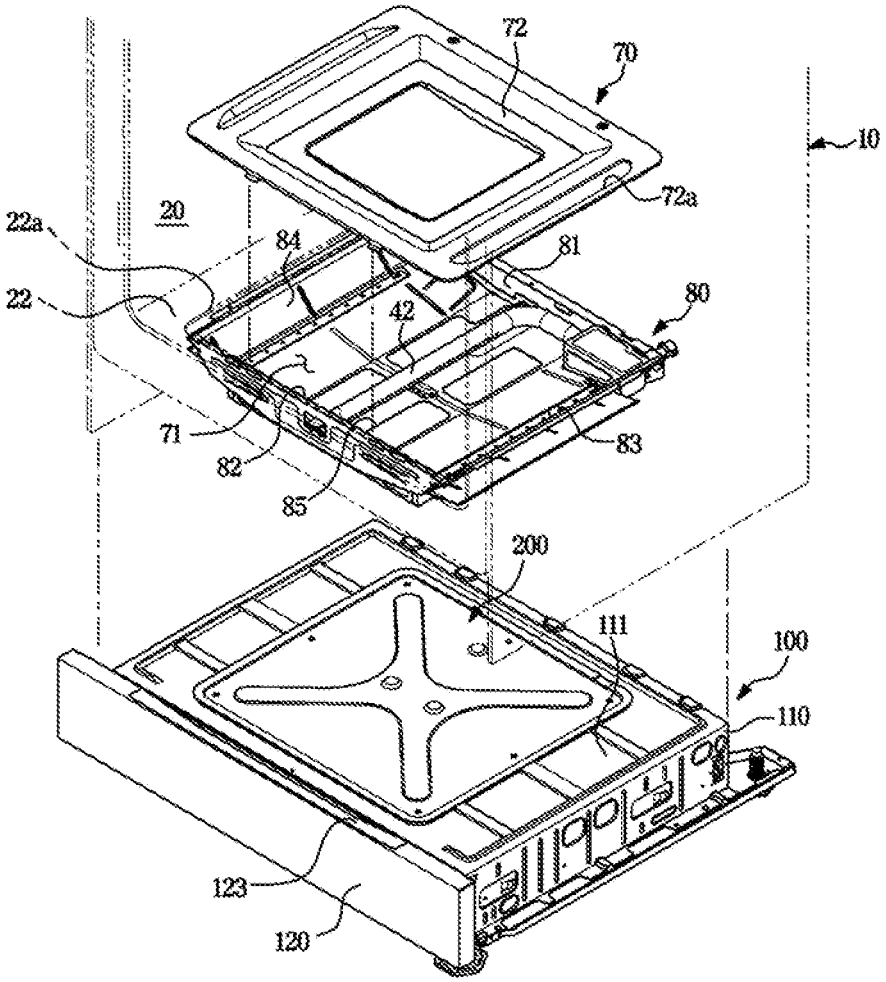
FIG. 4 is a partial exploded perspective view illustrating a lower portion of a cooking chamber and the drawer device of the oven according to one embodiment of the present disclosure.
Figure 5:
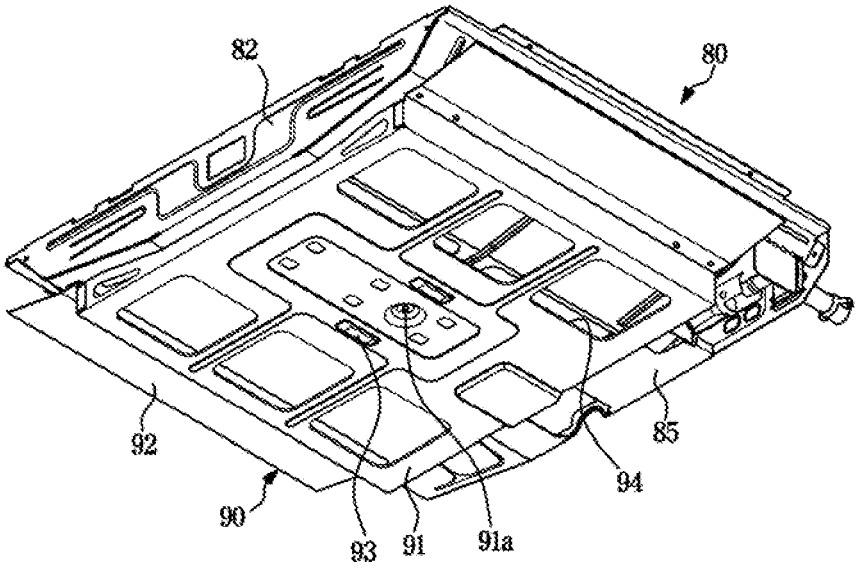
FIG. 5 is a view illustrating the lower portion of the cooking chamber and a bracket according to one embodiment of the present disclosure.

FIG. 3 is a cross-sectional view taken along line A-A' of FIG. 1 and shows a cross-section of a lower portion and a drawer device of the oven according to one embodiment of the present disclosure, FIG. 4 is a partial exploded perspective view illustrating a lower portion of a cooking chamber and the drawer device of the oven according to one embodiment of the present disclosure, and FIG. 5 is a view illustrating the lower portion of the cooking chamber and a bracket according to one embodiment of the present disclosure.

As illustrated in FIGS. 3 to 5, the body 10 of the oven 1 may include the burner accommodating chamber 71 for installing at least one of the plurality of burners 40 provided to heat the cooking chamber 20.

The oven 1 may further include the burner accommodating chamber 71 provided inside the body 10 to communicate with the cooking chamber 20. The burner accommodating chamber 71 may be positioned at the lower portion of the cooking chamber 20 to accommodate the second burner 42. The cooking chamber 20 and the burner accommodating chamber 71 may be connected by a bottom plate 70.

The oven 1 may further include the bottom plate 70 coupled to the lower wall 22 of the cooking chamber 20. The lower wall 22 of the cooking chamber 20 may include an opening 22*a*. The opening 22*a* formed in the lower wall 22 of the cooking chamber 20 may be connected to the burner accommodating chamber 71. The bottom plate 70 may be coupled to the lower wall 22 of the cooking chamber 20 to be positioned inside the cooking chamber 20. The bottom plate 70 may be coupled to the lower wall 22 to cover the opening 22*a* of the lower wall 22.

The bottom plate 70 may include a plate-shaped bottom plate body 72 and a hot air outlet 72*a* formed in the bottom plate body 72. The hot air outlet 72*a* may be formed in both side portions of the bottom plate body 72 to be adjacent to the sidewalls 23 and 24 of the cooking chamber 20. The plurality of hot air outlets 72*a* may be formed to pass through the bottom plate body 72 so that hot air generated by the second burner 42 is supplied to the cooking chamber 20.

The bottom plate 70 may be provided to cover the burner accommodating chamber 71 provided at the lower portion of the body 10. The burner accommodating chamber 71 may be provided by a lower bracket 80. The lower bracket 80 is provided inside the body 10 and may be provided to allow the second burner 42 to be installed. The lower bracket 80 is formed to accommodate the second burner 42 therein. The lower bracket 80 may include a rear surface 81, a left side surface 84, and a right side surface 83 positioned under the rear wall 25, the left sidewall 24, and the right sidewall 23, respectively, of the cooking chamber 20. The lower bracket 80 may include a front surface 82 positioned under the front opening of the cooking chamber 20. The lower bracket 80 may include a lower surface 85 positioned under the front surface 82, the rear surface 81, the left side surface 84, and the right side surface 83 of the lower bracket 80. The front surface 82, the rear surface 81, the left side surface 84, the right side surface 83, and the lower surface 85 of the lower bracket 80 form the burner accommodating chamber 71 to allow the second burner 42 to be accommodated and installed inside the lower bracket 80. The left side surface 84 and the right side surface 83 of the lower bracket 80 may be formed as curved surfaces to guide hot air generated by the second burner 42 to the cooking chamber 20.

The lower bracket 80 may further include a bracket 90 provided to cover the second burner 42 (see FIG. 5). The bracket 90 may be provided to cover the lower bracket 80 from under the lower bracket 80. The bracket 90 may be provided to cover the second burner 42 from under the lower bracket 80. The bracket 90 may be provided to be coupled to the lower bracket 80 to cover the second burner 42. The bracket 90 may be provided to insulate hot air generated by the second burner 42. The bracket 90 may be provided to reduce radiant heat between the bracket 90 and the lower bracket 80. The bracket 90 may include a bottom surface 91 which is provided to correspond to a lower portion of the lower bracket 80 to cover the lower portion and a guide surface 92 which is provided to extend from both sides of the bottom surface 91 to cover the left side surface 84 and the right side surface 83 of the lower bracket 80. A through-hole 94 may be formed to pass through the bottom surface 91 of the bracket 90 to allow air to flow. The through-hole 94 may be formed as a plurality of through-holes 94. The bracket 90 and the lower bracket 80 may be coupled through a fastener 91*a* formed on the bottom surface 91. A rib 93 protruding downward may be formed on the bottom surface 91 of the bracket 90. The rib 93 may be provided as a plurality of ribs 93. The rib 93 may be provided to reinforce strength of the bracket 90 and the bottom surface 91. The rib 93 may be provided to maintain a distance between the bracket 90 and the drawer device 100 which will be described below. The case in which the lower bracket 80 and the bracket 90 are provided as separate configurations and coupled has been described above as an example in the embodiment of the present disclosure, but the idea of the present disclosure is not limited thereto. For example, the lower bracket and the bracket may be integrally configured.

The second burner 42 may heat air inside the burner accommodating chamber 71, and the heated air inside the burner accommodating chamber 71 may enter the cooking chamber 20 due to natural convection and heat an object to be cooked that is placed inside the cooking chamber 20.

The second burner 42 is provided in the shape of a pipe, and a plurality of hot air discharge holes 43 may be formed in the second burner 42 to allow hot air generated therein to be discharged. Hot air from flames that is discharged through the plurality of hot air discharge holes 43 may be supplied to the cooking chamber 20 through the hot air outlets 72*a* of the bottom plate 70.

The drawer device 100 may be provided at a lower portion of the oven 1, that is, under the body 10. The drawer device 100 may be provided under the cooking chamber 20. The drawer device 100 may be positioned under the second burner 42. The drawer device 100 may be disposed under the lower bracket 80 and the bracket 90.

The drawer device 100 may be provided to heat an object to be cooked or a food container for holding an object to be cooked.

Figure 6:
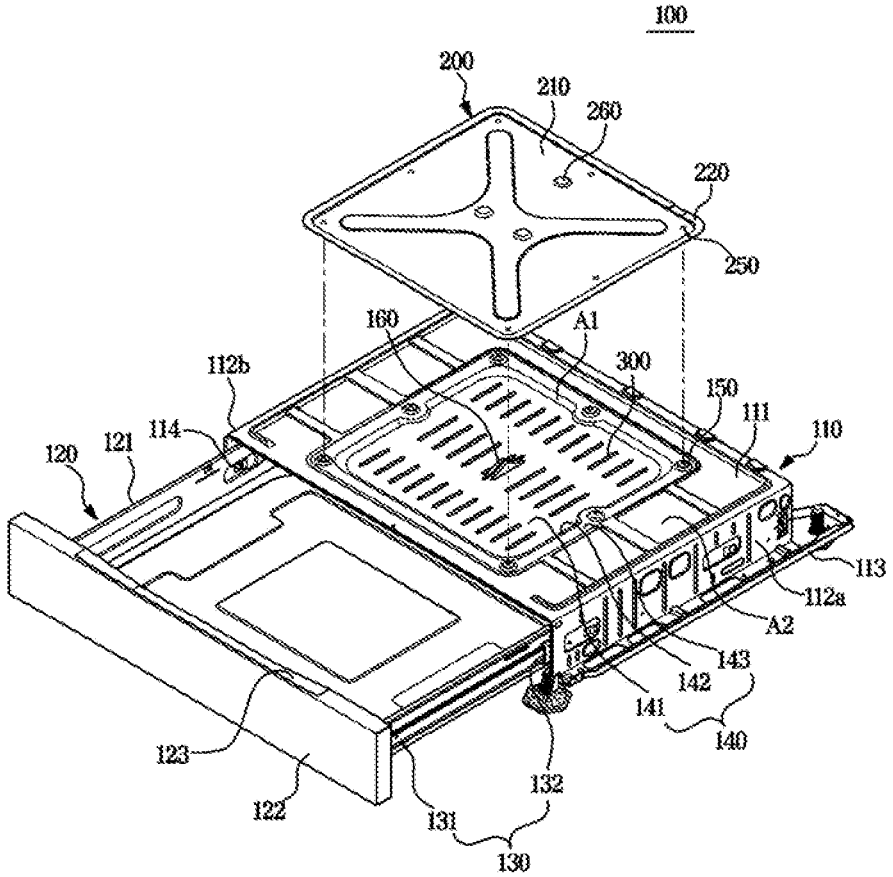
FIG. 6 is a partial exploded perspective view illustrating the drawer device of the oven according to one embodiment of the present disclosure.
Figure 7:
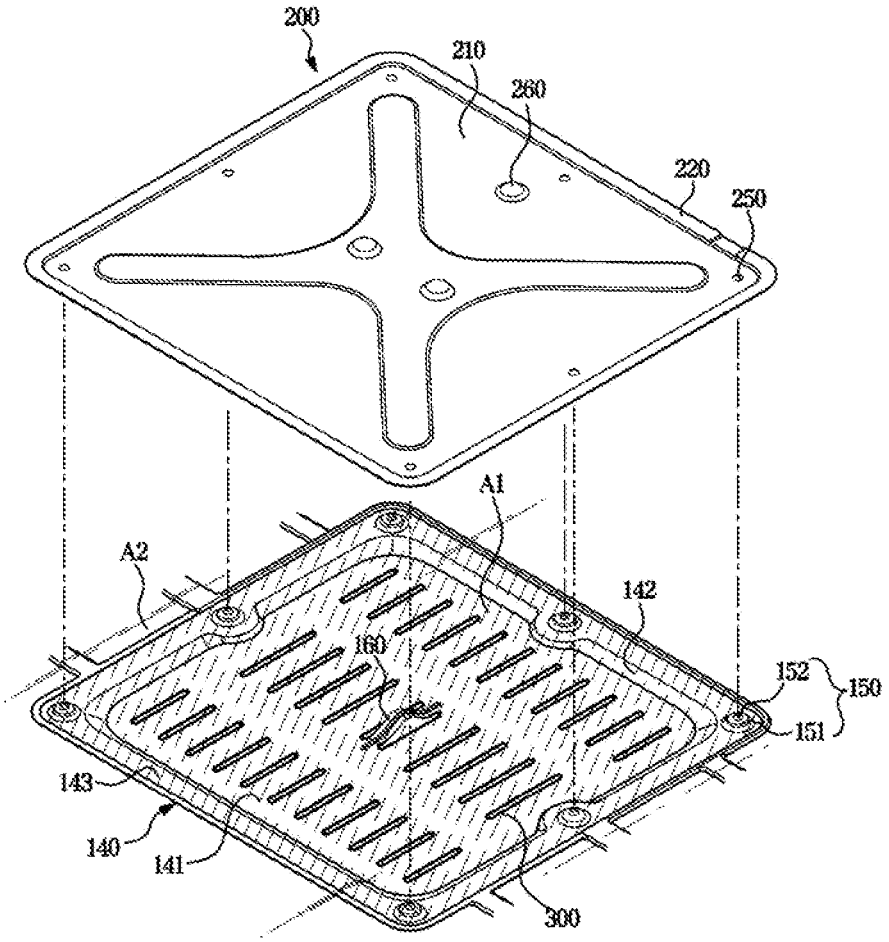
FIG. 7 is a perspective view illustrating a plate coupled to an upper surface of the drawer device according to one embodiment of the present disclosure.
Figure 8:
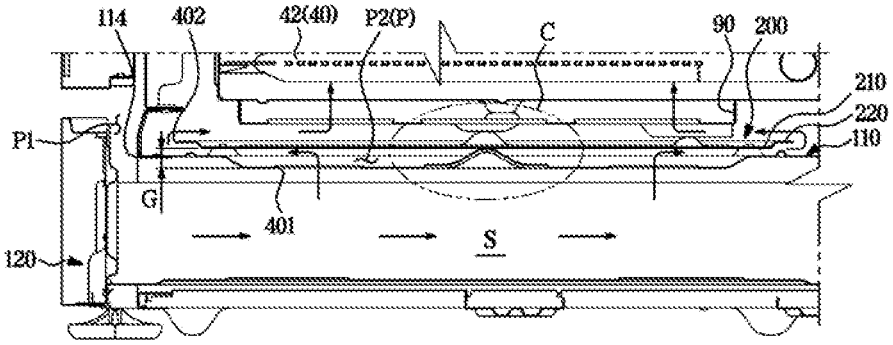
FIG. 8 is a view illustrating a flow path formed due to the plate of the drawer device according to one embodiment of the present disclosure.
Figure 9:
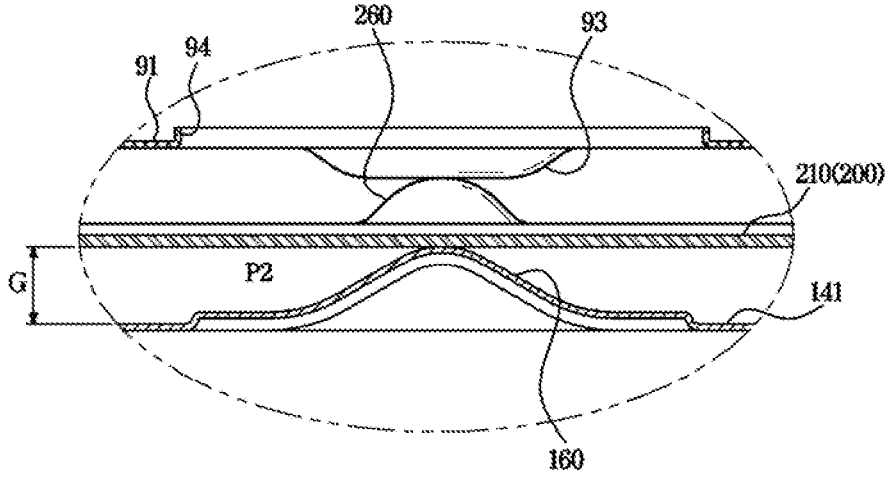
FIG. 9 is an enlarged view of portion C of FIG. 8 and shows a structure for maintaining distances between the upper surface and the plate of the drawer device and the plate and the bracket according to one embodiment of the present disclosure.

FIG. 6 is a partial exploded perspective view illustrating the drawer device of the oven according to one embodiment of the present disclosure, FIG. 7 is a perspective view illustrating a plate coupled to an upper surface of the drawer device according to one embodiment of the present disclosure, FIG. 8 is a view illustrating a flow path formed due to the plate of the drawer device according to one embodiment of the present disclosure, and FIG. 9 is an enlarged view of portion C of FIG. 8 and shows a structure for maintaining distances between the upper surface and the plate of the drawer device and the plate and the bracket according to one embodiment of the present disclosure.

As illustrated in FIGS. 6 to 9, the drawer device 100 of the oven 1 may include a drawer case 110 and a drawer 120 provided to be insertable into and withdrawable from the drawer case 110 in the front-rear direction.

The drawer device 100 may further include a plate 200 coupled to the drawer case 110. The drawer device 100 may further include the plate 200 coupled to an upper surface 111 of the drawer case 110.

The drawer device 100 may include the drawer 120 provided to be insertable or withdrawable in the front-rear direction of the oven 1. The drawer 120 is a place for substantially storing an object to be cooked or a food container holding an object to be cooked and is provided to be movable into or out of the oven 1.

The drawer 120 may include a drawer body 121 and a front panel 122 provided at a front of the drawer body 121. The front panel 122 may be installed at the front of the drawer body 121.

In order to provide a sense of unity with the exterior of the oven 1, the front panel 122 of the drawer 120 may be formed of the same material as the body 10 or the door 30 of the oven 1.

A drawer handle 123 may be provided at the front panel 122 of the drawer 120. The drawer handle 123 is provided to be gripped by a user to insert or withdraw the drawer 120 into or from the oven 1.

The drawer body 121 may be formed in a hexahedral shape with an open top to form an inner space S in which an object to be cooked or a food container for holding an object to be cooked is stored.

A rail device 130 may be provided at both outer side surfaces of the drawer body 121 to move the drawer 120. A first rail 131 of the rail device 130 may be provided at both side surfaces of the drawer body 121. The first rail 131 may be provided to slide the drawer body 121 in the front-rear direction of the oven 1.

A second rail 132 configured to correspond to the first rail 131 of the drawer body 121 may be provided at the drawer case 110.

The drawer case 110 may be disposed inside the body 10 of the oven 1. The drawer case 110 may include the upper surface 111, and a first side surface 112*a* and a second side surface 112*b* formed to extend downward from both left and right ends of the upper surface 111. The drawer case 110 may include an opening 114 at a front that is formed by the upper surface 111 and the first and second side surfaces 112*a* and 112*b*. The drawer 120 may be inserted and withdrawn through the opening 114 of the drawer case 110.

The drawer case 110 may further include a base 113 provided to support a floor. The base 113 of the drawer case 110 may be provided at ends of the first and second side surfaces 112*a* and 112*b*. The base 113 may be provided to stably support the drawer case 110 on the floor. The case in which the drawer case 110 is only formed of the upper surface 111 and the first and second side surfaces 112*a* and 112*b* has been described above as an example in the embodiment of the present disclosure, but the idea of the present disclosure is not limited thereto. For example, the drawer case may include a box having an open front to allow the drawer to be inserted and withdrawn in the front-rear direction.

The upper surface 111 of the drawer case 110 may include a first area A1 and a second area A2 excluding the first area A1. The first area A1 of the drawer case 110 may be positioned at a center of the upper surface 111. The second area A2 of the drawer case 110 may be positioned at an edge of the upper surface 111.

A hole 300 may be formed in the first area A1 of the upper surface 111. The hole 300 may be formed as a plurality of holes 300 in the first area A1 of the upper surface 111. The hole 300 may be formed to pass through the upper surface 111. The hole 300 may further include a slit formed by at least a portion of the upper surface 111 being cut out. The hole 300 may be provided as a plurality of holes 300 disposed to be spaced apart from each other in the first area A1.

A first area portion 140 may be provided in the first area A1 of the drawer case 110. The first area portion 140 may include a first area surface portion 141 formed to be recessed from the upper surface 111, an edge portion 143 formed at an edge of the first area surface portion 141, and an inclined portion 142 formed to be inclined to connect the first area surface portion 141 and the edge portion 143.

The first area surface portion 141 of the drawer case 110 may be positioned to be recessed downward from the upper surface 111 of the drawer case 110. The plurality of holes 300 may be formed in the first area surface portion 141. The first area surface portion 141 may be formed in a quadrangular shape.

The edge portion 143 of the drawer case 110 may be formed to be positioned above the first area surface portion 141 and connected to the upper surface 111. A support protrusion 150 formed to protrude to support the plate 200 may be provided on the edge portion 143. The support protrusion 150 may be provided as a plurality of support protrusions 150 disposed to be spaced apart from each other on a circumference of an edge of the first area A1. The support protrusion 150 may be provided to support the plate 200. The support protrusion 150 may be provided to support the plate 200 so that the plate 200 is spaced apart from the upper surface. Due to the support protrusion 150, the plate 200 may be spaced apart from the upper surface 111 of the drawer case 110, and a gap G may be formed.

The support protrusion 150 may include a first protruding portion 151 formed to extend from the edge portion 143 of the first area A1 and a second protruding portion 152 formed to protrude upward from the first protruding portion 151. The second protruding portion 152 may be formed in a smaller size than the first protruding portion 151. The second protruding portion 152 may be formed to have a smaller diameter than the first protruding portion 151.

The case in which the number of support protrusions is seven has been described above as an example in the embodiment of the present disclosure, but the idea of the present disclosure is not limited thereto. For example, the number of support protrusions may be changed according to the size and shape of the plate.

The plate 200 provided on the upper surface 111 of the drawer case 110 may be provided in a plate shape. The plate 200 may be mounted to correspond to the first area A1 of the upper surface 111. The plate 200 may be disposed to cover the hole 300 formed in the first area portion 140.

The plate 200 may include a first portion 210 configured to correspond to the first area A1 of the drawer case 110 and a second portion 220 formed at an edge of the first portion 210. The first portion 210 of the plate 200 may be formed in a flat plate shape. The first portion 210 of the plate 200 may be formed in a size that corresponds to the first area A1 to face the first area A1. The second portion 220 of the plate 200 may protrude from the first area A1 and correspond to the upper surface 111 of the drawer case 110, that is, the second area A2.

The plate 200 may be disposed to cover the lower portion of the cooking chamber 20 and block moisture, oil, and the like generated from the cooking chamber 20. The plate 200 may be disposed under the lower bracket 80 and the bracket 90 and collect foreign matter falling from the cooking chamber 20 and the bracket 90.

A support hole 250 configured to correspond to the support protrusion 150 may be formed in the plate 200. The support hole 250 may be formed in the first portion 210 of the plate 200. The support hole 250 is formed to allow at least a portion of the support protrusion 150 to be inserted and supported. The support hole 250 may be formed in a size that corresponds to the second protruding portion 152 of the support protrusion 150. The second protruding portion 152 of the support protrusion 150 may be inserted into the support hole 250, and the support hole 250 may be supported by the first protruding portion 151.

The plate 200 is provided to be supported to be spaced upward from the first area A1 of the drawer case 110. The plate 200 may be supported by the support protrusion 150 formed on the edge portion 143 of the first area A1 and disposed to be spaced upward from the drawer case 110.

The drawer case 110 may further include a stopper 160 configured to support at least a portion of the plate 200 to maintain a distance between the drawer case 110 and the plate 200. The drawer case 110 may include the stopper 160 formed to protrude from the first area A1 to support at least a portion of the plate 200. The stopper 160 may be formed to protrude from the first area surface portion 141 of the drawer case 110. The stopper 160 may be provided to elastically support at least a portion of a lower surface of the plate 200 from the center of the first area surface portion 141. The stopper 160 may be disposed on the first area surface portion 141. The stopper 160 is provided to prevent contact that may occur as the plate 200 expands due to a temperature rise. The plate 200 may expand due to a temperature rise. The stopper 160 may be provided to prevent the distance between the drawer case 110 and the plate 200 from decreasing due to the expansion of the plate 200.

The case in which a single stopper 160 is disposed at the center to support the center of the plate has been described above as an example in the embodiment of the present disclosure, but the idea of the present disclosure is not limited thereto. For example, the number of stoppers may be changed according to the size and shape of the plate.

The plate 200 may further include a distance maintainer 260 provided to maintain a distance between the plate 200 and the bracket 90 provided at a lower end of the cooking chamber 20. The distance maintainer 260 of the plate 200 may include an embossed shape formed to protrude upward from the plate 200.

The distance maintainer 260 of the plate 200 may be formed on at least any one of the first portion 210 and the second portion 220. The distance maintainer 260 may be formed by at least a portion of the plate 200 protruding upward. The distance maintainer 260 is provided to constantly maintain the distance between the plate 200 and the lower bracket 80. The distance maintainer 260 may be provided to prevent the distance from the lower bracket 80 and the bracket 90 to the plate 200 from decreasing or changing due to the expansion of the plate 200. The distance maintainer 260 may be formed by at least a portion of the plate 200 protruding in an embossed shape, and the distance maintainer 260 may be provided to be disposed to correspond to the rib 93, which is formed to protrude from the bracket 90, and come in point contact with the rib 93. A temperature rise due to conduction may be prevented by the distance maintainer 260 provided to come in point contact with the bracket 90.

Figure 10:
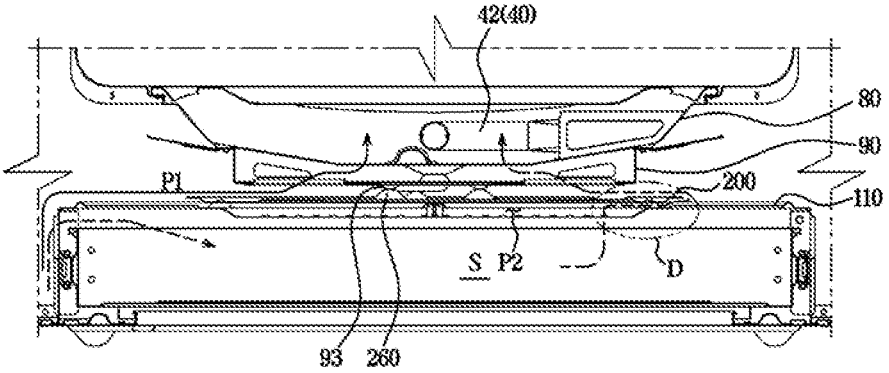
FIG. 10 is a cross-sectional view taken along line B-B' of FIG. 1 and shows a flow path of the drawer device according to one embodiment of the present disclosure.
Figure 11:
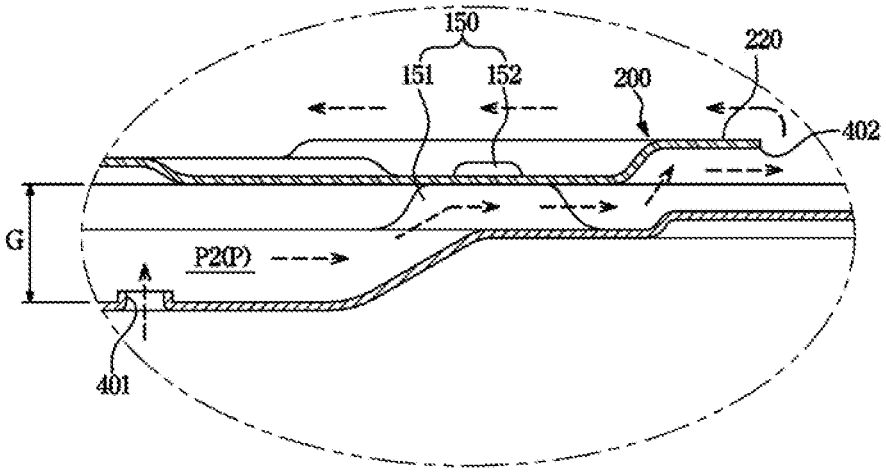
FIG. 11 is an enlarged view of portion D of FIG. 10 and shows a flow path formed due to the plate of the drawer device according to one embodiment of the present disclosure.

FIG. 10 is a cross-sectional view taken along line B-B' of FIG. 1 and shows a flow path of the drawer device according to one embodiment of the present disclosure, and FIG. 11 is an enlarged view of portion D of FIG. 10 and shows a flow path formed due to the plate of the drawer device according to one embodiment of the present disclosure.

As illustrated in FIGS. 10 and 11, the plate 200 mounted on the drawer case 110 of the drawer device 100 may be spaced apart from the upper surface 111 of the drawer case 110, and the gap G may be formed therebetween.

The plate 200 may be disposed to be spaced upward from the first area A1 of the drawer case 110, and the gap G may be formed between the plate 200 and the first area A1.

The gap G between the plate 200 and the upper surface 111 of the drawer case 110 blocks heat generated by the second burner 42 of the cooking chamber 20 and has an insulating effect. As radiant heat is shielded by the plate 200, an increase in the surface temperature of the drawer case 110 can be prevented.

The gap G formed between the plate 200 and the upper surface 111 of the drawer case 110 may form a flow path P along which air flows after entering through the hole 300 from the inner space S of the drawer case 110.

The plate 200 may form the flow path P between the plate 200 and the hole 300 formed in the first area surface portion 141 of the drawer case 110.

The flow path P formed between the plate 200 and the plurality of holes 300 formed in the upper surface 111 of the drawer case 110 allows the plate 200, which has been heated up due to radiant heat, to be additionally cooled by air moving through the plurality of holes 300 inside the drawer case 110, thus having an effect of preventing an increase in the surface temperature of the drawer case 110.

For example, in the case of a gas oven, the maximum surface temperature of the drawer case 110 is 180° C. when the gap G is present between the upper surface 111 of the drawer case 110 and the plate 200, and the maximum surface temperature of the drawer case 110 is decreased to 143° C. when the flow path P is formed by the gap G between the plurality of holes 300 formed in the upper surface 111 of the drawer case 110 and the plate 200.

Also, in the case of an electric oven, the maximum surface temperature of the drawer case 110 is 149° C. when the gap G is present between the upper surface 111 of the drawer case 110 and the plate 200, and the maximum surface temperature of the drawer case 110 is decreased to 135° C. when the flow path P is formed by the gap G between the plurality of holes 300 formed in the upper surface 111 of the drawer case 110 and the plate 200.

Specifically, the flow path P formed by the plate 200 may include an inlet portion 401 formed by the plurality of holes 300 and an outlet portion 402 formed between the edge portion 143 of the first area A1 and the second portion 220 of the plate 200 to allow the air entering through the inlet portion 401 to be discharged.

The flow path P formed by the plate 200 and the upper surface 111 of the drawer case 110 allows air to be introduced through the plurality of holes 300 formed in the upper surface 111 and allows air to be discharged through the gap G formed between the second portion 220, which is formed at the edge of the plate 200, and the upper surface 111 of the drawer case 110.

The flow path P including the inlet portion 401 and the outlet portion 402 to allow air to be introduced and discharged through the plurality of holes 300 formed in the drawer case 110 allows heat of the plate 200 to be additionally cooled and thus can improve an insulating effect.

Also, air in the inner space S of the drawer case 110 may be introduced into the flow path P through the plurality of holes 300 formed in the upper surface 111 of the drawer case 110, the air introduced into the flow path P may be discharged through the outlet portion 402 formed at edges of four sides of the plate 200, and the discharged air may be supplied to the second burner 42 at an upper side.

The air supplied to the second burner 42 through the flow path P may be introduced into the second burner 42, facilitate combustion, reduce spread of flames, and reduce radiant heat transferred from the second burner 42.

In the case of the conventional oven 1, the drawer device 100 may include a first insulating flow path P1 formed around the drawer case 110 due to outside air being introduced through the opening 114 of the drawer case 110. The first insulating flow path P1 is provided to perform primary insulation as outside air is introduced through the front opening 114 of the drawer case 110 and the introduced air is introduced between the drawer case 110 and the second burner 42 disposed at the lower portion of the cooking chamber 20.

Here, some of the air introduced through the first insulating flow path P1 may move to the second burner 42 and be supplied as combustion air.

The oven 1 may further include the plate 200 disposed to have the gap G from the upper surface 111 of the drawer case 110 and a flow path P (hereinafter referred to as a second insulating flow path P2) formed by the plate 200 and the holes 300 formed in the upper surface 111 of the drawer case 110.

The second insulating flow path P2 may be formed by the plate 200 which is disposed to be spaced apart from the first area A1 of the drawer case 110 to have the gap G therefrom.

Air in the inner space S of the drawer case 110 is introduced into the second insulating flow path P2 through the plurality of holes 300 formed in the upper surface 111 of the drawer case 110. The air introduced into the second insulating flow path P2 cools the plate 200 and is discharged through the outlet portion 402 formed by the second portion 220 at the edge of the plate 200 and the edge portion 143 of the first area A1.

Here, the air discharged from the second insulating flow path P2 through the outlet portion 402 may be supplied to the second burner 42, facilitate complete combustion of the second burner 42, and reduce spread of flames.

The drawer case 110 of the drawer device 100 may block radiant heat generated by the second burner 42 at the lower portion of the cooking chamber 20 through the first insulating flow path P1 and the second insulating flow path P2 and may use the air in the inner space S of the drawer case 110 to provide additional insulation while cooling the plate 200.

Also, since the air in the inner space S of the drawer case 110 can be supplied as combustion air of the second burner 42 through the second insulating flow path P2, an air introduction flow path can be secured, and thus, the combustion efficiency can be improved.

Figure 12:
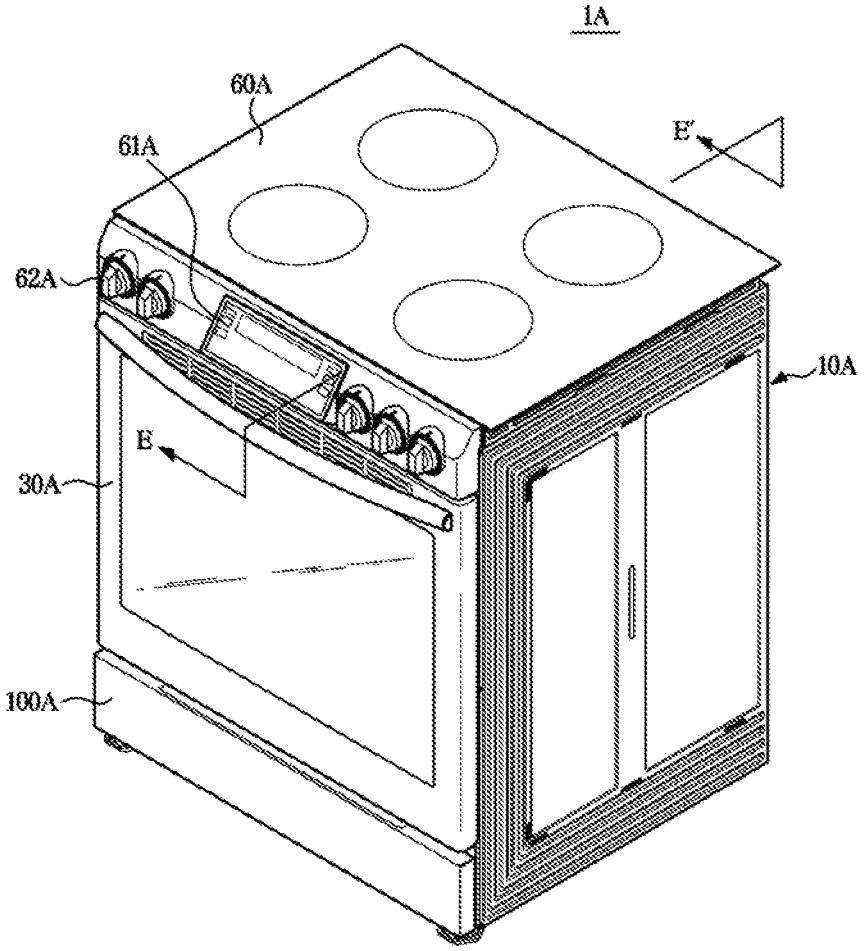
FIG. 12 is a perspective view of an oven according to another embodiment of the present disclosure.
Figure 13:
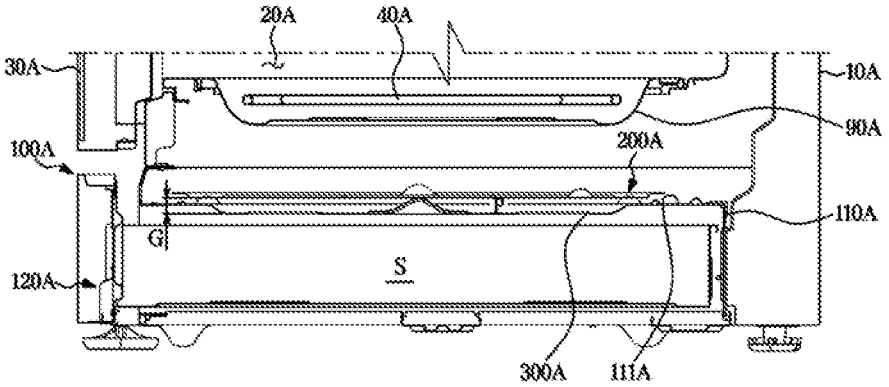
FIG. 13 is a cross-sectional view taken along line E-E' of FIG. 12 and shows a cross-section of a lower portion and a drawer device of the oven according to another embodiment of the present disclosure.

FIG. 12 is a perspective view of an oven according to another embodiment of the present disclosure, and FIG. 13 is a cross-sectional view taken along line E-E' of FIG. 12 and shows a cross-section of a lower portion and a drawer device of the oven according to another embodiment of the present disclosure. Refer to FIGS. 1 to 11 for reference numerals of elements not denoted by reference numerals in FIGS. 12 and 13.

As illustrated in FIGS. 12 and 13, an oven 1A may include a body 10A forming an exterior and having a cooking chamber 20A positioned therein and a cooktop 60A provided at an upper end of the oven 1A and provided so that a container holding an object to be cooked is placed thereon and heated.

An operation panel 62A configured to receive an operation command from a user and a display 61A configured to display operational information of the oven 1A may be provided at an upper portion of a front surface of the body 10A. The operation panel 62A may be provided to allow the user to input an operation signal for operating the cooktop 60A, the oven 1A, and a drawer device 100A.

An electric heater 40A for heating an inside of the cooking chamber 20A may be provided at an upper side or a lower side of the cooking chamber 20A of the oven 1A. The electric heater 40A may include an upper heater (not illustrated) and a lower heater 40A. The heater 40A may be covered by a heater case 90A.

The oven 1A may have the drawer device 100A provided under the body 10A. The drawer device 100A may be provided to heat an object to be cooked or food containers for holding an object to be cooked.

The drawer device 100A may include a drawer case 110A and a drawer 120A provided to be insertable into and withdrawable from the drawer case 110A in the front-rear direction.

The drawer device 100A may further include a plate 200A coupled to the drawer case 110A. The drawer device 100A may further include the plate 200A coupled to an upper surface 111A of the drawer case 110A.

A plurality of holes 300A may be formed in the upper surface 111A of the drawer case 110A. The holes 300A may be formed to pass through the upper surface 111A. The holes 300A may further include slits formed by at least a portion of the upper surface 111A being cut out. Air in an inner space S of the drawer case 110A may move through the holes 300A.

The plate 200A may be spaced apart from the upper surface 111A of the drawer case 110A, and a gap G may be formed therebetween.

The gap G between the plate 200A and the upper surface 111A of the drawer case 110A blocks heat generated by the heater 40A of the cooking chamber 20A and has an insulating effect. As radiant heat is shielded by the plate 200A, an increase in the surface temperature of the drawer case 110A can be prevented.

The gap G formed between the plate 200A and the upper surface 111A of the drawer case 110A may form a flow path P along which air flows after entering through the holes 300A from the inner space S of the drawer case 110A.

The flow path P formed between the plate 200A and the plurality of holes 300A formed in the upper surface 111A of the drawer case 110A allows the plate 200A, which has been heated up due to radiant heat, to be additionally cooled by air moving through the plurality of holes 300A inside the drawer case 110A, thus having an effect of preventing an increase in the surface temperature of the drawer case 110A.

The technical idea of the present disclosure has been described above using specific embodiments, but the scope of rights of the present disclosure is not limited by the embodiments. Various embodiments obtained by those of ordinary skill in the art to which the present disclosure pertains making modifications or alterations within the scope not departing from the gist of the technical idea of the present disclosure stated in the claims also belong to the scope of rights of the present disclosure.

What is claimed is:

1. An oven comprising:

a body having a cooking chamber in the body;

a heat source in the cooking chamber to heat the cooking chamber; and a drawer device under the body, and including:

a drawer case having an upper surface with a first area having one or more holes extending through the upper surface, and a second area that is higher than the first area, outside of the first area, and at an edge of the upper surface, and a plate having a first portion above the first area of the upper surface of the drawer case and covering the one or more holes, and a second portion outside of the first portion, at an edge of the plate, and above at least a portion of the second area of the upper surface of the drawer case, such that a gap is formed between the plate and the upper surface of the drawer case, and a flow path is provided between the plate and the upper surface of the drawer case for air in the drawer case to flow through the one or more holes, then through the gap to be discharged through an outlet formed between the edge of the plate and the second area of the upper surface of the drawer case to be supplied to the heat source.

2. The oven of claim 1, wherein the heat source includes at least one of a burner and a heater.

3. The oven of claim 1, wherein:

the one or more holes is a plurality of holes spaced apart from each other in the first area, and the second portion of the plate is higher than the first portion of the plate.

4. The oven of claim 3, wherein:

the first portion of the plate is flat.

5. The oven of claim 1, wherein the drawer case further includes one or more support protrusions supporting the plate such that the plate is spaced apart from the upper surface of the drawer case.

6. The oven of claim 5, wherein the first area includes:

a first area surface portion recessed downward, a first area edge portion at an edge of the first area surface portion, and being higher than the first area surface portion, and an inclined portion connecting the first area surface portion and the first area edge portion.

7. The oven of claim 6, wherein the one or more support protrusions is a plurality of support protrusions spaced apart from each other on the first area edge portion.

8. The oven of claim 6, wherein the drawer case includes a stopper protruding from the first area surface portion to elastically support at least a portion of the plate.

9. The oven of claim 6, wherein:

the body further includes a bracket covering the heat source, and the plate includes a distance maintainer protruding from at least one of the first portion of the plate and the first area of the upper surface of the drawer case to maintain a distance between the plate and the bracket.

10. The oven of claim 9, wherein the distance maintainer has an embossed shape.

11. The oven of claim 5, wherein the plate further includes one or more support holes through which the one or more support protrusions are inserted and supported, respectively.

12. The oven of claim 11, wherein the one or more support holes is in the first portion of the plate.

* * * * *